United States Patent [19]

Areson

[11] 4,073,122

[45] Feb. 14, 1978

[54] PRINTING APPARATUS

[75] Inventor: Peter D. W. Areson, Boston, Mass.

[73] Assignee: Markem Corporation, Keene, N.H.

[21] Appl. No.: 677,780

[22] Filed: Apr. 16, 1976

[51] Int. Cl.[2] ..... B65B 61/26

[52] U.S. Cl. ..... 53/131; 53/189; 101/44

[58] Field of Search ..... 53/131, 189, 385; 101/41, 44, 298, 301

[56] References Cited

U.S. PATENT DOCUMENTS

| | | | |
|---|---|---|---|
| 3,190,054 | 6/1965 | Arnold | 53/131 |
| 3,247,787 | 4/1966 | Ryckman | 101/44 |
| 3,358,414 | 12/1967 | Hersch et al. | 53/385 X |
| 3,508,379 | 4/1970 | Noyes et al. | 53/189 |
| 3,579,951 | 5/1971 | Lowery | 53/189 X |
| 3,763,774 | 10/1973 | Pearl et al. | 101/41 |
| 3,771,448 | 11/1973 | Thomson et al. | 101/44 |
| 3,823,664 | 7/1974 | Shenotta | 101/41 |
| 3,877,367 | 4/1975 | Norwood | 101/44 |

*Primary Examiner*—Othell M. Simpson
*Assistant Examiner*—John Sipos

[57] ABSTRACT

Printing apparatus especially useful for printing on the generally horizontal upper surface of the upper uninflated bag of a stack of generally flat, uninflated bags, while an inflated bag is positioned thereabove at the top of the stack for subsequently receiving a product therein.

It includes a print head having a print face, preferably horizontally positioned, and print head carrier means for moving the print head from an inoperative position to a remote printing position along a curved path, its motion being initially away from the inoperative position, preferably in a generally horizontal direction, and finally toward the printing position in a generally perpendicular, preferably vertical, direction to the upper surface of the upper, uninflated bag for printing its upper surface.

There may be included bag deflecting means for deflecting the inflated bag from the printing position to expose at least a portion of the upper surface of the upper, uninflated bag for printing thereon. The deflecting means may consist of an air jet mounted adjacent the print head for movement therewith to deflect the inflated bag in advance of print head movement.

8 Claims, 9 Drawing Figures

FIG 1
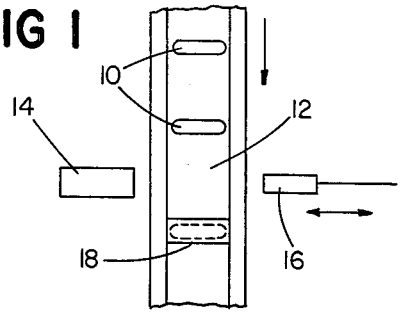
FIG 2
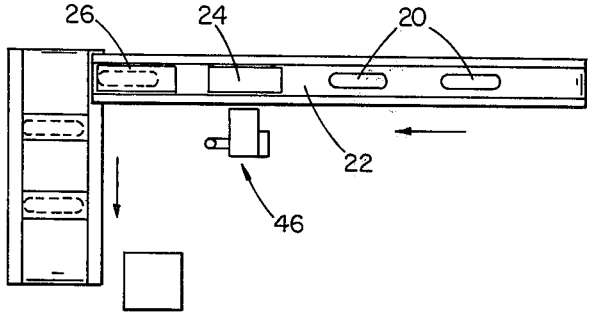
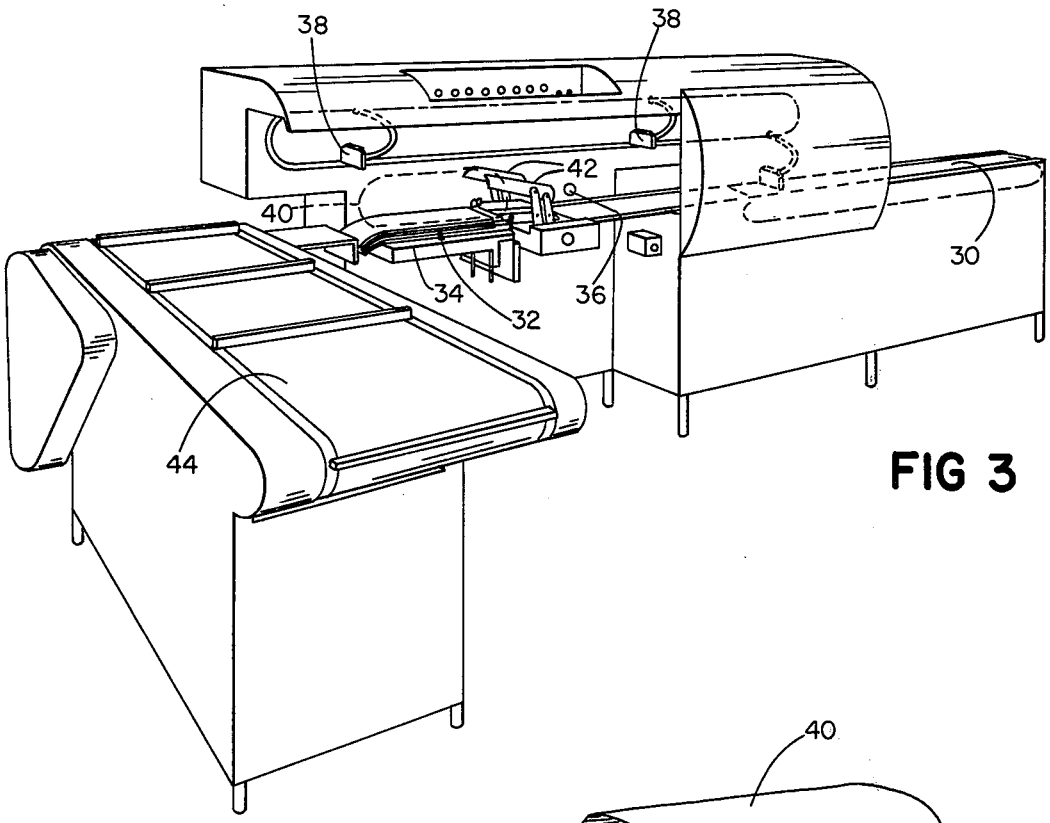
FIG 3
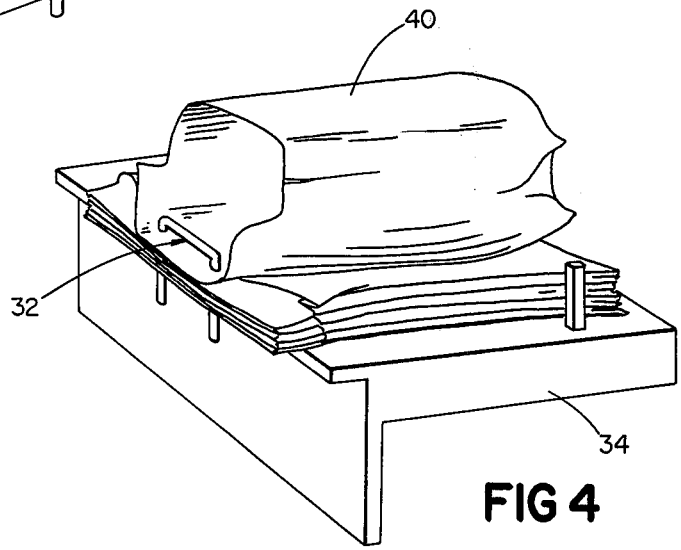
FIG 4

PRINTING APPARATUS

This invention concerns printing apparatus and, more particularly, such apparatus especially useful for printing on the upper uninflated bag of a stack of flat, uninflated bags, while an inflated bag is positioned thereabove for subsequently receiving a product therein, without interfering with the operation of a bagging machine. It especially concerns apparatus capable of accomplishing such printing in cooperation with a bagging machine of straight line configuration, without interrupting or slowing the operation of the bagging machine.

In the operation of bagging many commercial products, such as loaves of bread or other baked products, rolls of tissue or paper towel, and even sweaters, bags supplied to the bagging machine are generally preprinted with such material as a description of the contents, trademarks, and an overall package design. However, it is often desired to add to the preprinted package current information such as the price, or the date of manufacture or date of last sale. Such information is subject to frequent change, but it is impractical frequently to vary the preprinted information on the bags, which are generally obtained in large lots far in advance of their use.

Various methods have been used to add such current data to the package. For example, printed labels may be secured to the package by adhesive. However, this method is expensive, and machines to attach such labels to bags have been found to be mechanically unreliable.

Alternatively, the data may be printed on the closure, which may be either a flat plastic lock or a wire and paper twist tie. The plastic locks are expensive, particularly if they are large enough to accomodate much information. The paper twist ties offer very little area for printing. Hence, these methods are not satisfactory.

Finally, data may be printed directly on the bag, at the time of filling the bag.

In a bagging machine of the type shown schematically in U.S. Pat. No. 3,358,414, or with a hand bagging machine, it is a relatively simple matter to provide a printing apparatus that prints on the stack of bags, for example, by apparatus of the type shown in U.S. Pat. No. 3,823,664.

However, printing apparatus of such type cannot be employed with a bagging machine of straight line configuration, that is, one in which the stack of bags is positioned in the line of travel of the products to be packaged, immediately below their path, and the packaged product travels on in the same direction.

There is therefore a need for printing apparatus that can be employed in cooperation with a straight line bagging machine and that will operate reliably without interfering with the operation of the bagging machine. Further, since such bagging machines desirably operate at high speeds, such as 70–75/minute, a satisfactory printing apparatus should not necessitate any reduction in the speed of operation of the bagging machine.

In view of the foregoing, it is a major object of the invention to provide a novel printing apparatus that can be used in conjunction with bagging machines of straight line configuration, as well as with other types of bagging machines, including hand bagging machines.

It is a particular object of the invention to provide printing apparatus for printing on the upper uninflated bag of a stack of generally flat, uninflated bags while an inflated bag is positioned thereabove for subsequently receiving a product therein, without interfering with the operation of whatever type of bagging machine it is used with.

It is another object of the invention to provide a novel printing apparatus that may be used in conjunction with known bagging machines without the need for substantial modification of such machines.

Accordingly, the present invention provides novel printing apparatus especially useful for printing on the generally horizontal upper surface of the upper, uninflated bag of a stack of generally flat, uninflated bags, while an inflated bag is positioned thereabove at the top of the stack for subsequently receiving a product therein.

It includes a print head having a print face, preferably horizontally positioned, and print head carrier means for moving the print head from an inoperative position to a remote printing position along a curved path, its motion being initially away from the inoperative position, preferably in a generally horizontal direction, and finally toward the printing position in a generally perpendicular, preferably vertical, direction to the upper surface of the upper, uninflated bag for printing on its upper surface. There may be, and usually is, included bag deflecting means for deflecting the inflated bag from the printing position to expose at least a portion of the upper surface of the upper, uninflated bag for printing thereon. The deflecting means may consist of an air jet mounted adjacent the print head for movement therewith to deflect the inflated bag in advance of print head movement.

More specifically, the print head carrier means may be supported on a frame having an inking means and include a print head arm carrying the print head, drive means connected to the arm for moving it bodily generally along the path between the inking means thereon and the printing position.

Cam and follower means are interposed between the arm and the frame for guiding the arm generally along the path. The cam and follower means may include a cam surface linearly extended generally in the direction of the path and a cam follower relatively movable therealong. The drive means bodily moves the arm and the cam surface and follower relatively to one another generally linearly in the direction of the path to move the print head along the path.

Other objects, features, and advantages will appear from the following description of a preferred embodiment of the invention, taken together with the attached drawings thereof, in which:

FIG. 1 is a schematic view of a known bagging machine, not of straight line configuration;

FIG. 2 is a schematic view of a known straight line bagging machine;

FIG. 3 is a perspective view of a straight line bagging machine like that of FIG. 2;

FIG. 4 shows a wicket of flat, uninflated bags with the top bag inflated;

Figure 5:
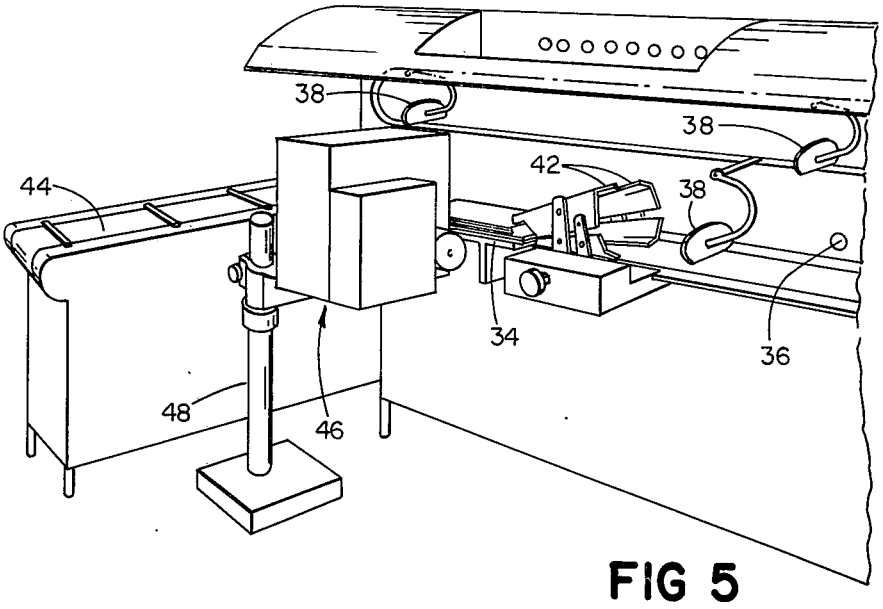
FIG. 5 shows part of the bagging machine of FIG. 3 with the printing apparatus of the invention in operating position.
Figure 7:
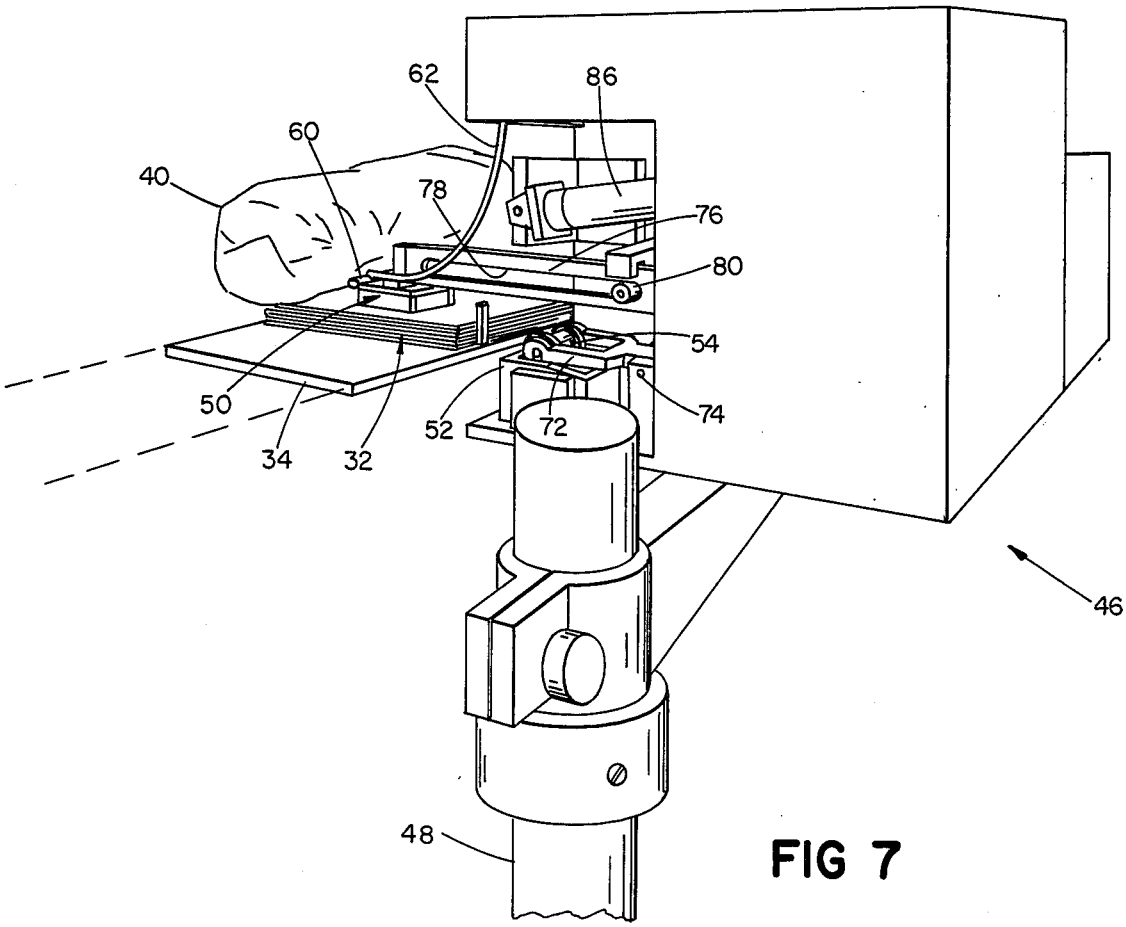
FIGS. 6 and 7 are enlarged perspective views of the printing apparatus of FIG. 5.

Referring to the drawings, in FIG. 1 is shown a bagging machine, such as is exemplified by the machine of U.S. Pat. No. 3,358,414, in which product units to be packaged, indicated at 10 in the Figure, are conveyed on a conveyer 12 to a position opposite a stack of bags 14. A movable structure such as a scoop 16 reaches across the conveyer to clasp an inflated bag and then pull it back over the product. The bagged item 18 is then conveyed to further stations for operations such as fastening the open end. Manual bagging machines are somewhat similar, except that the operator places the product within the air-jet inflated bag on top of a stack of uninflated bags. In all of such bagging machines, it is well known to provide a printing apparatus that prints on bags beside the packaging machine and such printing can be accomplished without interfering with the operation of the packaging machine.

A bagging machine of straight line configuration is shown schematically in FIG. 2. In such a machine, product units 20 to be bagged are carried on a conveyer 22 toward a stack of bags 24, positioned in the line of travel of the items and immediately below their path. The item is packaged and travels on in the same direction, as indicated at 26.

In more detail, FIG. 3 shows a straight line bragging machine of the type schematically illustrated in FIG. 2, made by Formost Packaging Machine, Incorporated, of Woodinville, Wash. shown in some detail in U.S. Pat. No. 3,508,379. The particular machine illustrated in FIGS. 2 and 3 hereof is intended to bag loaves of bread, which are conveyed to the bagging station on infeed conveyer 30. A wicket of bags 32 is supported on a self-adjusting bag table 34, in line with the path of the loaves. An incoming loaf is delivered to the bagging machine by its infeed conveyer 30. One of the moving paddles 38 comes into position behind the loaf and pushes it forward. A photo electric cell 36 senses the presence of the loaf and the signal from this cell initiates the cycle of operation of the machine. The top bag of the wicket is inflated, as indicated in phantom at 40; the openers 42 are inserted into the inflated bag and extended (as seen in this Figure) to stretch the mouth of the bag open; the loaf is inserted into the bag by the paddle 38 as it passes over bag table 34. When the loaf reaches the bottom of the bag, the openers release their hold on the bag, which is then torn from the wicket by continued forward pressure of paddle 38 on the bagged loaf. The bagged product is pushed by paddle 38 onto the closure conveyer 44, the openers 42 retract, and the next cycle begins when another loaf is sensed.

FIG. 4 shows a wicket 32 of bags supported on bag table 34, the top bag 40 being inflated to receive a product, which would be fed from the left as seen in this Figure.

FIG. 5 shows the bagging machine of FIG. 3 with the printer 46 of the invention in its operating position beside the bagging machine. In this Figure, the openers 42 are unextended.

Figure 6:
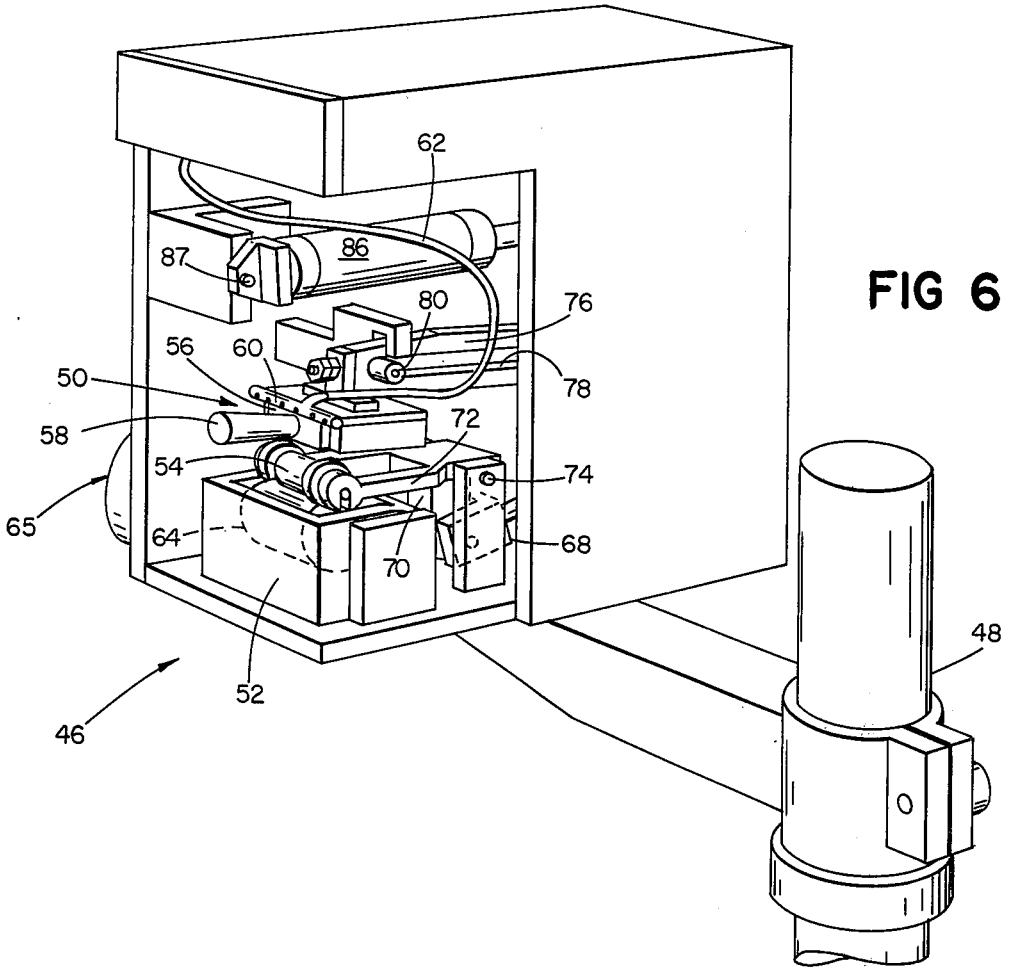
Figure 8:
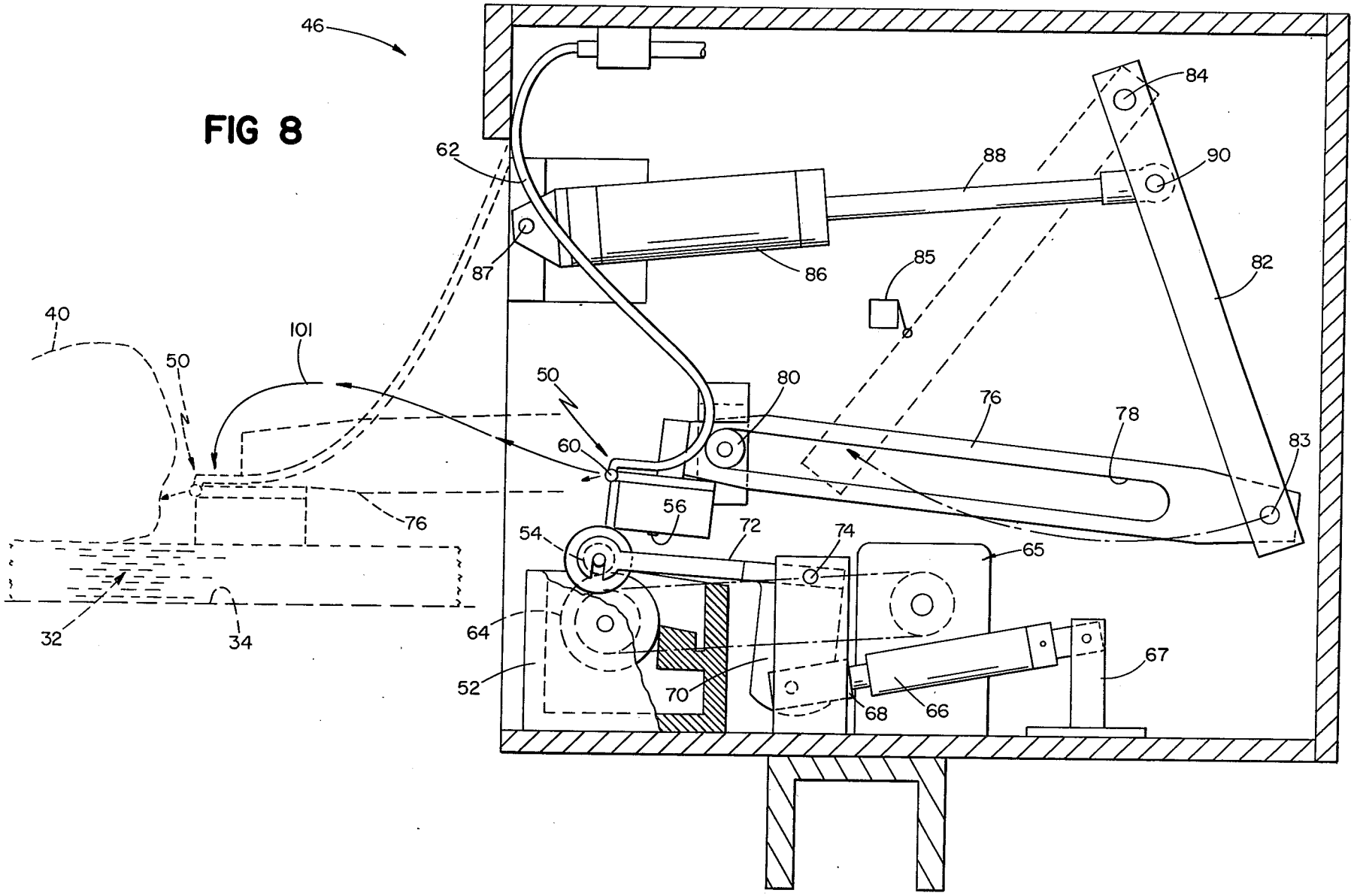
FIG. 8 is a detailed side view of the printing apparatus of FIGS. 5 through 7.

Referring now to FIGS. 6 and 8, the printer 46 of the invention is supported on a stand 48. The principal elements of the printer 46 are a print head 50 having a generally planar removable print face 56, positioned in a generally horizontal plane, an ink reservoir 52 and an ink roll 54, together with air cylinders and linkages to cause the print head to print. Print head 50 removable print face 56 has a detachable handle 58 (FIG. 6), which is used to insert and remove the face carrying the type. The print face is heated by a heating element in the print head, not shown. An air manifold 60 is provided across the leading edge of print head 50, and is supplied through flexible tubing 62 with air under pressure from a source, not shown in this Figure, but indicated in the schematic diagram of FIG. 9.

Ink reservoir 52 includes an internal reservoir roll 64, continuously driven from a motor 65 (FIG. 6). The ink in the reservoir is heated by a heater (not shown). In the rest position of the printing mechanism, ink roll 54 is in contact with driven reservoir roll 64, and out of contact with type face 56.

Two air cylinders operate the printer. The single acting ink roll air cylinder 66 is spring returned and is mounted in clevis mounting bracket 67; its piston is fitted with a rod clevis assembly 68, which receives link 70 of ink roll carrier 72. Ink roll carrier 72 is pivoted at 74, and supports ink roll 54.

Print head 50 is carried on print head arm 76, which provides an internal cam surface 78 that slides over a stationary roller bearing 80 fixed to the printer frame. A print head drive link 82 is pivotally connected at 83 to the end of arm 76 remote from print head 50. Link 82 is pivotally mounted on the printer frame at 84. The double acting print head air cylinder 86 is mounted on the printer frame at 87, and its piston 88 is connected to link 82 at 90, between link mounting 84 and the connection 83 to arm 76. A microswitch 85 (FIG. 8) is mounted on the frame in such a position that the switch is actuated by drive link 82 when print head 50 is in print position.

When the piston of air cylinder 66 is retracted, as seen in FIG. 8, the surfaces of ink roll 54 and driven reservoir roll 64 are in contact. When the piston is advanced, carrier 72 pivots at 74, raising ink roll 54 out of contact with driven roll 64 into a position in which the generally horizontally positioned print face 56 can wipe roll 54 as it moves outwardly to print.

OPERATION

The operation of the printer may be controlled in any convenient manner, appropriate to the configuration of the particular bagging machine with which it is used. In connection with a hand operated bagging machine, the operation of the printer may be controlled by a foot switch.

Figure 9:
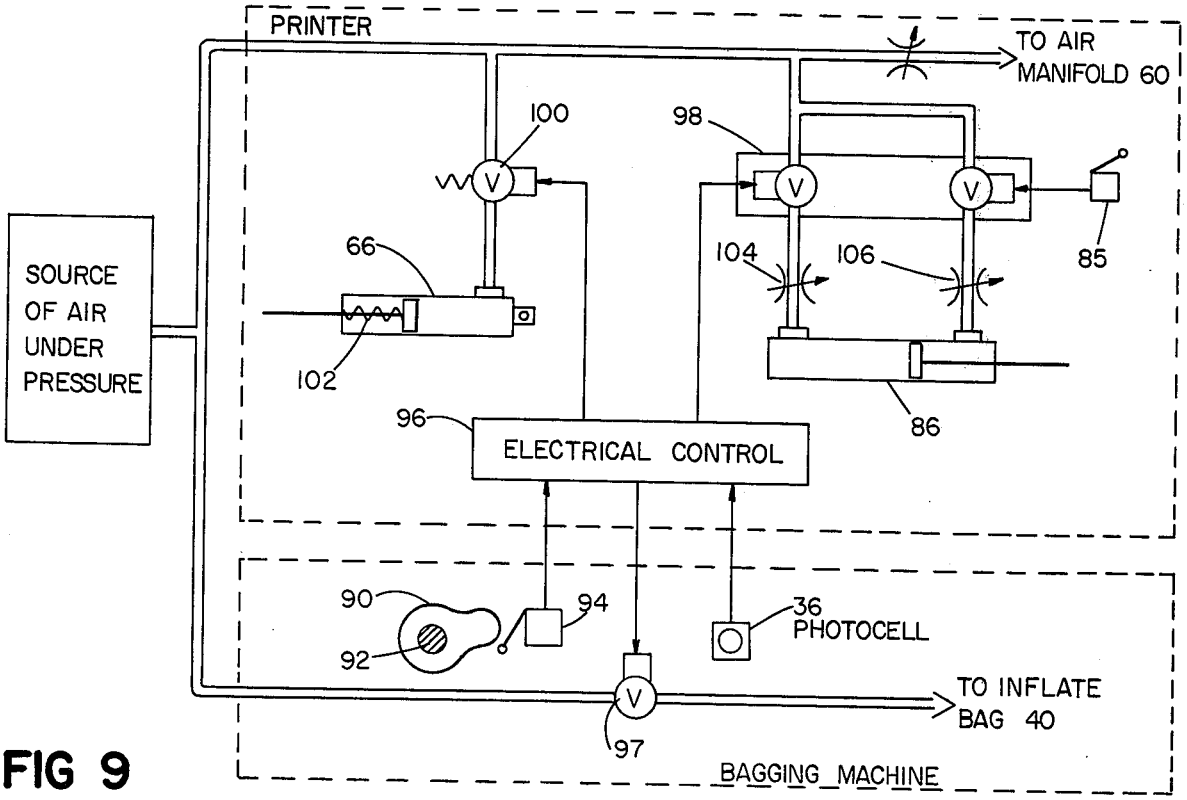
FIG. 9 is a schematic showing of the pneumatic and electrical connections of the printing apparatus of FIGS. 5 through 8.

In the specific embodiment herein shown, referring now to FIG. 9, the timing of the printer is controlled by a cam 90 fitted to the main drive shaft 92 of the bagging machine with which the printer is used. At an appropriate time in the bagging machine cycle, cam 90 closes a microswitch 94 whose signal is input to an electrical control unit 96 (together with the signal from photocell 36, FIG. 3).

The bagging machine and the printer are supplied with air from a common source. Under the control of electrical control unit 96, solenoid operated valve 97 supplies air to the bagging machine jet to inflate the top bag of the stack. In the printer, four-way solenoid operated valve 98 supplies air to print head air cylinder 86, which advances print head arm 76. At the same time, valve 100 supplies air to ink roll air cylinder 66 to raise ink roll 54 into the position in which print head 50 wipes across ink roll 54. Air is also supplied to air manifold 60 carried on print head 50, which displaces the inflated top bag 40, so that the heated type face 56 does not contact the bag, and the printing area of the top uninflated bag is exposed.

The arrows 101 in FIG. 8 illustrate the path described by print head 50 during the printing operation. Print head 50 is constrained to follow a generally curved path and is moved initially generally horizontally, in a direction generally parallel to print face 56, from its inoperative position to a position above the stack of uninflated bags. The final portion of the path is generally vertical, perpendicular to the upper surface of the upper uninflated bag so that print head 50 contacts the topmost uninflated bag without any significant horizontal motion. This avoids smearing the printed information. Print face 56 is maintained in a generally horizontal plane throughout its travel along its curved path.

The piston of ink roll cylinder 66 is returned by an internal spring 102, thereby returning ink roll 54 into contact with driven roll 64. At the end of the printing stroke, drive link 82 actuates microswitch 85, which causes valve 98 to retract piston 88 of print head air cylinder 86 and thereby to retract print head 50 to its inoperative position.

It is advantageous to provide that the return stroke of the print head is faster than the printing stroke. This is accomplished by setting two flow controls 104 and 106.

At the final portion of the printing stroke, the force exerted by the print head on the stack of bags is weak, and the end position of the stroke is not fixed. The print head can hit the resilient stack of bags, supported on a springy table, with a light contact.

I claim:

1. Printing apparatus for printing on the surface of an article in a printing position remote from said apparatus comprising a frame a print head having a generally planar print face print head carrier means supported on said frame for moving said print head from an inoperative position to said printing position along a curved path, said motion being initially away from said inoperative position in a direction generally parallel to the plane of said print face and finally toward said printing position in a direction generally perpendicular to said print face for printing the surface of an article in printing position said print head carrier means including a print head arm carrying said print head drive means connected to said arm for moving it bodily generally along said path and cam and follower means interposed between said arm and said frame for guiding said arm generally along said path said cam and follower means include a cam surface linearly extended generally in the direction of said path and a cam follower relatively moveable therealong said drive means bodily moving said arm and said cam surface and follower relatively to one another generally linearly in the direction of said path to move said print head along said path.

2. In combination with a bagging machine for loading a product unit into a bag, said machine having bagging machine timing means feed means to convey product units along a feed path bag support means to support a stack of generally flat, uninflated bags adjacent said feed path bag expanding means responsive to the approach of a product unit to said bag stack to expand a top bag of said stack, and loading means to load a product into said expanded top bag, printing apparatus comprising a frame a print head having a print face bag deflecting means independent of said bag expanding means to deflect said expanded top bag, exposing at least a portion of the top surface of the next underlying unexpanded bag and print head carrier means supported on said frame and responsive to said bagging machine timing means to move said print head in a curved path generally horizontally from a position remote from said bag stack to a position above said bag stack, thereafter to move said print head generally vertically downwardly into printing contact with said exposed bag surface, and thereafter to remove said print head to said remote position, before said bagging machine loading means loads a product unit into said expanded top bag said print head carrier means including a print head arm carrying said print head, and drive means connected to said arm for moving it bodily generally linearly in the direction of said path.

3. In the combination of claim 2, wherein said print head carrier means further includes cam and follower means interposed between said arm and said frame for guiding said arm generally along said path, said cam and follower means including a cam surface linearly extended generally in the direction of said path and a cam follower relatively movable therealong said drive means bodily moving said arm and said cam surface and follower relatively to one another generally linearly in the direction of said path to move said print head along said path.

4. In the combination of claim 2, wherein said bag support means is in said feed path and said print head path is perpendicular to said feed path.

5. Printing apparatus for printing on the surface of an article in a printing position remote from said apparatus comprising a frame, a print head having a generally planar print face, print head carrier means movably mounted on said frame for moving said print head from an inoperative position to said printing position along a curved path, said motion being initially away from said inoperative position in a direction generally parallel to the plane of said print face and finally toward said printing position in a direction generally perpendicular to said print face for printing the surface of an article in printing position, said print head carrier means including a print head arm having an internal cam surface, said print head being carried at a first end of said print head arm, a print head drive link having a first end pivotally connected to the second end of said print head arm and a second end pivotally connected to said frame, drive means connected to said link for pivoting said link about said link second end, and cam follower means secured to said frame, said print head arm internal cam surface sliding on said cam follower means.

6. In combination with a bagging machine for loading a product unit into a bag, said machine having a frame, bagging machine timing means, feed means to convey product units along a feed path, bag support means to support a stack of generally flat, uninflated bags adjacent said feed path, bag expanding means responsive to the approach of a product unit to said bag stack to expand a top bag of said stack, and loading means to load a product into said expanded top bag, printing apparatus comprising a print head having a print face, bag deflecting means to deflect said expanded top bag, exposing at least a portion of the top surface of the next underlying, unexpanded bag, print head carrier means movably mounted on said frame and responsive to said bagging machine timing means to move said print head in a curved path generally horizontally from a position remote from said bag stack to a position above said bag stack, thereafter to move said print head generally vertically downwardly into printing contact with said exposed bag surface and thereafter to remove said print head to said remote position before said bagging machine loading means loads a product unit into said expanded top bag said print head carrier means including a print head arm having an internal cam surface, said print head being carried at a first end of said print head arm, a print head drive link having a first end pivotally connected to the second end of said print head arm and a second end pivotally connected to said frame, drive means connected to said link for pivoting said link about said link second end, and cam follower means secured to said frame, said print head arm internal cam surface sliding on said cam follower means.

7. Printing apparatus for printing on the surface of an article in a printing remote from said apparatus comprising a frame, a print head having a generally planar print face, print head carrier means movably mounted on said frame for moving said print head from an inoperative position to said printing position along a curved path, said motion being initially away from said inoperative position in a direction generally parallel to the plane of said print face and finally toward said printing position in a direction generally perpendicular to said print face for printing the surface of an article in printing position, said print head carrier means including a print head arm having a cam surface, said print head being carried at a first end of said print head arm, a print head drive link having a first end pivotally connected to the second end of said print head arm and a second end pivotally connected to said frame, drive means connected to said link for pivoting said link about said link second end, and cam follower means secured to said frame, said print head arm cam surface sliding on said cam follower means.

8. In combination with a bagging machine for loading a product unit into a bag, said machine having a frame, bagging machine timing means, feed means to convey product units along a feed path, bag support means to support a stack of generally flat, uninflated bags adjacent said feed path, bag expanding means responsive to the approach of a product unit to said bag stack to expand a top bag of said stack, and loading means to load a product into said expanded top bag, printing apparatus comprising a print head having a print face, bag deflecting means to deflect said expanded top bag, exposing at least a portion of the top surface of the next underlying, unexpanded bag, print head carrier means movably mounted on said frame and responsive to said bagging machine timing means to move said print head in a curved path generally horizontally from a position remote from said bag stack to a position above said bag stack, thereafter to move said print head generally vertically downwardly into printing contact with said exposed bag surface and thereafter to remove said print head to said remote position before said bagging machine loading means loads a product unit into said expanded top bag said print head carrier means including a print head arm having a cam surface, said print head being carried at a first end of said print head arm, a print head drive link having a first end pivotally connected to the second end of said print head arm and a second end pivotally connected to said frame, drive means connected to said link for pivoting said link about said link second end, and cam follower means secured to said frame, said print head arm cam surface sliding on said cam follower means.

* * * * *